US005965317A

United States Patent [19]

Sato et al.

[11] Patent Number: 5,965,317

[45] Date of Patent: Oct. 12, 1999

[54] REGENERATION OF CARRIER AND ELECTROPHOTOGRAPHIC DEVELOPER CONTAINING REGENERATED CARRIER

[75] Inventors: Yuji Sato; Tsuyoshi Itagoshi; Toshio Honjo, all of Chiba-ken, Japan

[73] Assignee: Powdertech Co., Ltd., Chiba-Ken, Japan

[21] Appl. No.: 09/225,465

[22] Filed: Jan. 6, 1999

[30] Foreign Application Priority Data

Jan. 8, 1998 [JP] Japan ..... 10-002194

[51] Int. Cl.[6] ..... G03G 9/113

[52] U.S. Cl. ..... 430/137

[58] Field of Search ..... 430/137

[56] References Cited

U.S. PATENT DOCUMENTS

| | | | |
|---|---|---|---|
| 4,511,639 | 4/1985 | Knott et al. | 430/137 |
| 4,726,994 | 2/1988 | Yoerger | 430/137 |

FOREIGN PATENT DOCUMENTS

| | | | |
|---|---|---|---|
| 53-126935 | 11/1978 | Japan | 430/137 |
| 63-212945 | 9/1988 | Japan | 430/137 |
| 3-89254 | 4/1991 | Japan . | |
| 6-149132 | 5/1994 | Japan . | |
| 7-28280 | 1/1995 | Japan . | |
| 1367478 | 7/1974 | United Kingdom . | |
| 1555258 | 11/1979 | United Kingdom | 430/137 |

OTHER PUBLICATIONS

Xerox Discl. Jour., vol. 19, No. 3, May/Jun. 1994, p. 263.

*Primary Examiner*—Roland Martin
*Attorney, Agent, or Firm*—Young & Thompson

[57] ABSTRACT

A method for regenerating a carrier coated with a silicone resin or a resin containing a silane coupling agent in an electrophotographic developer comprising the carrier and a toner, which comprises separating the developer into the carrier and the toner, immersing the separated carrier in an aqueous alkali solution, and stirring the mixture to remove the toner component adhered to the carrier surface and the coating resin.

6 Claims, No Drawings

REGENERATION OF CARRIER AND ELECTROPHOTOGRAPHIC DEVELOPER CONTAINING REGENERATED CARRIER

BACKGROUND OF THE INVENTION

1. Field of the Invention

The present invention relates to a method for regenerating a carrier coated with a silicone resin or a resin containing a silane coupling agent in a spent electrophotographic developer which has been fatigued from continuous use in a copying machine, printer, etc. and to an electrophotographic developer containing the regenerated carrier.

2. Description of the Related Art

A two-component dry developer used for developing an electrostatic latent image in electrophotography comprises a toner and a carrier. The carrier is mixed and agitated with the toner in a development box to give a desired charge quantity to the toner and carries the charged toner onto an electrostatic latent image formed on a photoreceptor to form a toner image.

The carrier remains on the magnet of the development box and is returned to the development box where it is again mixed and agitated with fresh toner particles for repeated use.

In order to maintain high image quality over a service life of a developer in a stable manner, the carrier is required to have stable characteristics over the life.

Many of the state-of-the-art carriers for two-component dry developers for electrostatic latent image development have a resin coat for obtaining high image quality.

Because a developer is always under the stress of collisions among the particles or with the wall of a development box or a photoreceptor, etc. during the service life, the toner adheres to the surface of the carrier particles due to the heat generated by the collisions (called spent-toner phenomenon). Further, the resin coat falls off the carrier particles or undergoes denaturation, and the carrier characteristics are deteriorated with time, and it eventually comes necessary to exchange the developer for a new one.

In order to prevent deterioration of carrier characteristics, studies have been made on the resin to be used to coat the surface of a carrier. Of various resins proposed to date a silicone resin having a low surface tension has now been prevailing. However, the conventional silicone resins are still insufficient for preventing the spent-toner phenomenon or deterioration (fall-off and denaturation) of the resin coat.

A developer exchanged due to deterioration has been disposed as waste. However, environmental pollution by industrial waste has given a rise to a social problem, and it has been a subject to reuse the collected developer.

Proposals on reuse of a collected developer, especially a carrier, are disclosed, e.g., in Japanese Patent Laid-Open Nos. 89254/91, 149132/94, and 28280/95. These proposals aim at removal of the spent toner component adhered on the carrier surface but not at removal of the resin coat. Therefore, the resin remains on the regenerated carrier. Since the resin remaining on the carrier surface has undergone not a little deterioration (fall-off or denaturation) as a result of long-term use, the regenerated carrier shows instability in performance, failing to restore various initial characteristics such as electrical resistance and charging properties, or the regenerated carrier has reduced durability.

It has also been proposed to remove both a spent toner and a resin coat by heat treatment or organic solvent treatment as disclosed in Japanese Patent Laid-Open Nos. 12286/72, 212945/88, and 72665/95. However, these techniques, while effective on carriers coated with a styrene-acrylic resin or a like resin, are ineffective on carriers coated with a silicone resin or a resin containing a silane coupling agent because such a resin coat leaves $SiO_2$ on the carrier surface when heat treated or the resin coat is insoluble in an organic solvent.

SUMMARY OF THE INVENTION

An object of the present invention is to provide a method for regenerating a fatigued carrier by removing the spent toner and the silicone resin or the resin containing a silane coupling agent thereby to restore the initial characteristics.

Another object of the present invention is to provide an electrophotographic developer containing the carrier thus regenerated.

As a result of extensive investigation, the inventors of the present invention have found that the above objects are accomplished by separating a spent developer into the carrier and the toner, immersing the separated carrier in an aqueous alkali solution, and stirring the mixture.

Having been completed based on the above finding, the present invention provides a method for regenerating a carrier coated with a silicone resin or a resin containing a silane coupling agent in an electrophotographic developer comprising the carrier and a toner, which comprises separating the developer into the carrier and the toner, immersing the separated carrier in an aqueous alkali solution, and stirring the mixture to remove the spent toner component adhered to the carrier surface and the silicone resin or the resin containing the silane coupling agent.

The present invention also provides an electrophotographic developer containing the carrier generated by the above-described method.

The method of regeneration according to the present invention makes it feasible to remove the spent toner and the coating resin, i.e., a silicone resin or a resin containing a silane coupling agent, from the carrier surface thereby to provide a regenerated carrier equal to a fresh carrier in characteristics. Use of the thus regenerated carrier in an electrophotographic developer eliminates the necessity of disposing the spent carrier, which solves the problem of environmental pollution and saves resources.

DETAILED DESCRIPTION OF THE INVENTION

In carrying out the regeneration method of the present invention, a developer collected at the expiration of its service life is subjected to a pretreatment for separating toner particles which are electrostatically adhered to the carrier and additives such as a fluidity improver. This can be achieved by utilizing the force of an air flow (blowing-off, air screening or air classification); heat treating in a rotary kiln, a calcination oven, a stationary oven, a fluidized bed oven, etc.; washing with water, an organic solvent, etc.; or a combination thereof When the force of an air flow is used, the air flow rate should be controlled so as not to separate carrier particles from the developer. The collected developer sometimes contains toner agglomerates perceivable to the naked eye, which cannot be removed by the method using the force of an air flow. Such toner agglomerates can be removed through a screensuch as a vibrating screen or a gyroshifter. Where heat treatment is carried out, the heating temperature should be at or above the toner decomposing temperature and below a temperature at which the carrier is not fused or undergoes further progress of ferrite reaction. The heat treatment is usually performed at a temperature of 200 to 900° C., preferably 400 to 800° C., particularly 600 to 700° C., for a period of 15 minutes or longer. The organic solvent to be used for washing is preferably selected from those capable of dissolving the toner.

The spend developer is thus separated into the carrier coated with a silicone resin or a resin containing a silane coupling agent and the toner. The silicone resin includes a straight silicone resin, a silicone resin modified with an acrylic resin, a polyester resin, an epoxy resin, an alkyd resin, a fluorine resin, a urethane resin, etc., and a mixture thereof The resin containing a silane coupling agent includes a resin having incorporated therein a silane coupling agent and a resin having been treated with a silane coupling agent as a primer.

The carrier thus separated is immersed in an aqueous alkali solution and washed by stirring. The aqueous alkali solution to be used for washing includes an aqueous solution of potassium hydroxide or sodium hydroxide. The concentration of the solution is preferably 5% by weight or more, still preferably 5 to 20% by weight, particularly preferably 7.5 to 12.5% by weight. If the concentration is less than 5%, the silicone resin or the resin containing a silane coupling agent may possibly remain unremoved. If the concentration exceeds 20%, bad economy can result, such that the past treatment, e.g., washing, takes time.

The temperature of the aqueous alkali solution is preferably 50° C. or higher, still preferably 70 to 100° C. When treated at room temperature, the silicone resin or the resin containing a silane coupling agent may tend to remain unremoved.

After the treatment with an aqueous alkali solution, the carrier is thoroughly washed with water. It is recommended to adjust the pH to 6 to 8 with an aqueous acid solution (e.g., hydrochloric acid) or an aqueous alkali solution (e.g., aqueous ammonia) prior to the washing with water. The washed carrier is dried spontaneously or, for preference, by heating at about 50 to 150° C.

The carrier thus cleared of the spent toner and the coating resin is equal to a fresh carrier core as prepared from the raw material. The carbon and silicon contents of the regenerated carrier are each small. The carrier is then coated with a resin as a core to regenerate itself into a resin-coated carrier for an electrophotographic developer having the initial characteristics before use.

The regenerated carrier can be re-fired to modify the surface properties and apparent density, the size of the regenerated carrier can be adjusted, and the furnace atmosphere can be fired by modifying oxygen concentration to adjust the magnetic characteristics and resistivity, if desired. The coating resin which can be used for coating the regenerated carrier is not limited in kind or additives added thereto. That is, the resulting resin-coated regenerated carrier may be different from what it has been before regeneration. Useful resins include not only the same silicone resin or the same silane coupling agent-containing resin as initially used but other resins such as a styrene-acrylic resin, a fluorocarbon resin, a polyethylene resin, a polyester resin, an epoxy resin, a urethane resin, and a phenyl resin. The additives such as a conducting agent and a charging agent, can differ from those initially present.

The carriers which can be applied to the regeneration method of the present invention include every type of carriers inclusive of all known for electrophotography such as iron powder, magnetite powder, and ferrite powder using Cu, Zn, Mg, Mn, Ca, Li, Sr, Sn, Ni, Al, Ba, Co, etc. The carriers are not limited in shape, surface properties, particle size, magnetic characteristics, resistivity, charging properties, and the like.

The carrier obtained by the regeneration method of the present invention is mixed with a toner into an electrophotographic two-component developer. The toner to be used comprises a binder resin having dispersed therein a charge control agent, a colorant, etc.

While not limiting, the binder resin which can be used in the toner includes polystyrene, chloropolystyrene, a styrene-chlorostyrene copolymer, a styrene-acrylate copolymer, a styrene-methacrylic acid copolymer, a rosin-modified maleic acid resin, an epoxy resin, a polyester resin, a polyethylene resin, a polypropylene resin, and a polyurethane resin. These binder resins can be used either individually or as a mixture thereof.

The charge control agent to be used in the toner is selected arbitrarily. Useful charge control agents for positively chargeable toners include nigrosine dyes and quaternary ammonium salts, and those for negatively chargeable toners include metallized monoazo dyes. Any known dyes and pigments are useful as a colorant. Examples of suitable colorants are carbon black, Phthalocyanine Blue, Permanent Red, Chrome Yellow, and Phthalocyanine Green. The toner can further contain external additives such as fine silica powder and titania, for improvement on fluidity and anti-agglomeration.

The method for preparing the toner is not particularly restricted. For example, a binder resin, a charge control agent and a colorant are dry blended thoroughly in a mixing machine, e.g., a Henschel mixer, and the blend is melt-kneaded in, e.g., a twin-screw extruder. After cooling, the mixture is ground, classified, and mixed with necessary additives in a mixing machine, etc.

The present invention will now be illustrated in greater detail with reference to Examples. Unless otherwise noted, all the percents are by weight.

EXAMPLE 1

Cu—Zn ferrite core $A_1$ having a saturation magnetization of 55 emu/g and an average particle size of 100 $\mu$m was coated with 0.5% of a methylsilicone resin to prepare carrier $A_2$. Carrier $A_2$ was mixed with a toner for a copier SF-7800 (manufactured by Sharp Corporation) to obtain developer $A_3$. After continuous copying was carried out on the copier SF-7800 using developer $A_3$ to obtain 100,000 copies, the spent developer (developer $A_4$ containing fatigued carrier $A_5$) was collected, and carrier $A_5$ was cleared of the toner adhering thereto electrostatically. The carrier $A_5$ was put in a stirrer together with a 10% potassium hydroxide aqueous solution heated to 70° C. and washed by stirring for 1 hour. After the pH was adjusted to 7.2, the carrier was washed with water and dried thoroughly in a drier to obtain core $A_6$.

As shown in Table 1 below, ICP analysis on the core $A_6$ revealed less than 0.01% by weight each of a C content and an Si content, proving that the spent toner and the coating resin on the carrier surface had been removed completely (the C and Si contents of core $A_1$ were each less than 0.01%).

Corer $A_6$ was again coated with a methylsilicone resin in the same manner as described above to obtain carrier $A_7$. The carrier characteristics of the carrier $A_7$ were equal to those of carrier $A_2$. Developer $A_8$ was prepared from carrier $A_7$ and a toner for a copier SF-7800, and continuous copying was carried out on that copier by using developer $A_8$ to obtain 100,000 copies. The charge quantity of developer $A_3$ in the initial stage of copying and after the continuous running were 11.2 $\mu$C/g and 15.6 $\mu$C/g, respectively, and those of developer $A_8$ were 11.4 $\mu$C/g and 15.1 $\mu$C/g, respectively, indicating substantial equality. As for image quality, there was observed no difference between developer $A_3$ and regenerated developer $A_8$ both in the initial stage and after the continuous running.

EXAMPLE 2

Carrier $A_5$ of collected developer $A_4$ was cleared of toner particles in the same manner as in Example 1 and washed by stirring in a 10% sodium hydroxide aqueous solution heated at 70° C. As shown in Table 1, it was revealed that the spent toner and the coating resin had been removed completely. In the same manner as in Example 1, the resulting carrier was again coated with a methylsilicone resin to prepare resin-coated carrier $A_9$, and developer $A_{10}$ was prepared from the carrier $A_9$. When tested in the same manner as in Example 1, developer $A_{10}$ showed no appreciable difference from developer $A_3$. The charge quantities in the initial stage and after continuous running are shown in Table 1.

EXAMPLE 3

Carrier $A_5$ of collected developer $A_4$ was cleared of toner particles in the same manner as in Example 1 and washed by stirring in a 10% potassium hydroxide aqueous solution heated at 50° C. As shown in Table 1, it was revealed that the spent toner and the coating resin had been removed completely. In the same manner as in Example 1, the resulting carrier was again coated with a methylsilicone resin to obtain resin-coated carrier $A_{11}$, from which developer $A_{12}$ was prepared. When developer $A_{12}$ was tested in the same manner as in Example 1, no appreciable difference was observed from developer $A_3$. The charge quantities in the initial stage and after continuous running are shown in Table 1.

Carrier $A_5$ of collected developer $A_4$ was cleared of toner particles in the same manner as in Example 1 and washed by stirring in a 3% potassium hydroxide aqueous solution heated at 70° C. The resulting core $A_{13}$ had a C content and an Si content of 0.01% and 0.02%, respectively, showing slight remaining of the coating resin. In the same manner as in Example 1, the resulting carrier was again coated with a methylsilicone resin to obtain resin-coated carrier $A_{,14}$, and developer $A_{15}$ was prepared. When developer $A_{15}$ was tested in the same manner as in Example 1, fog developed in the initial stage, but durability was secured up to the end of the copying test. The charge quantities in the initial stage and after continuous running are shown in Table 1.

EXAMPLE 5

Carrier $A_5$ of collected developer $A_4$ was cleared of toner particles in the same manner as in Example 1 and washed by stirring in a 10% potassium hydroxide aqueous solution at room temperature. The resulting core $A_{16}$ had a C content of 0.04% and an Si content of 0.08%, indicating that the coating resin was not completely removed. The C and Si contents of carrier $A_2$ were 0.09% and 0.15%, respectively. In the same manner as in Example 1, the resulting carrier was again coated with a methylsilicone resin to obtain resin-coated carrier $A_{17}$, and developer $A_{18}$ was prepared. When developer $A_{18}$ was tested in the same manner as in Example 1, fog developed in the initial stage, but durability was secured up to the end of the copying test. The charge quantities in the initial stage and after continuous running are shown in Table 1.

EXAMPLE 6

Carrier $A_5$ of collected developer $A_4$ was cleared of toner particles in the same manner as in Example 1 and washed by stirring in a 10% potassium hydroxide aqueous solution heated at 50° C. The pH was adjusted to 5.3, and the carrier was dried thoroughly in a drier to obtain core $A_{19}$ . As shown in Table 1, the C content and Si content of the resulting core $A_{19}$ were each less than 0.01%, revealing that the spent toner and the coating resin had been removed completely. In the same manner as in Example 1, core $A_{19}$ was again coated with a methylsilicone resin to obtain coated carrier $A_{20}$, from which developer $A_{21}$ was prepared. When developer $A_{21}$ was tested in the same manner as in Example 1, slight fog developed in the initial stage, but durability was secured up to the end of the copying test. The charge quantities in the initial stage and after continuous running are shown in Table 1.

Comparative Example 1

Carrier $A_5$ of collected developer $A_4$ was cleared of toner particles in the same manner as in Example 1 and fired at 700° C. in a tunnel kiln. As shown in Table 1, although the C content of the resulting carrier was less than 0.01%, the Si content was found to be 0.12%. In the same manner as in Example 1, the carrier was again coated with a methylsilicone resin to obtain resin-coated carrier $A_{22}$, and the developer was prepared by using carrier $A_{22}$. When tested in the same manner as in Example 1, the developer caused considerable fog from the initial stage, not withstanding continuous use. The initial charge quantity is shown in Table 1.

Comparative Example 2

Carrier $A_5$ of collected developer $A_4$ was cleared of toner particles in the same manner as in Example 1 and washed with toluene (organic solvent) by stirring. The resulting carrier $A_{23}$ had no spent toner. The C content and Si content of carrier $A_{23}$ were 0.07% by weight and 0.12% by weight, respectively. In the continuous running test of the developer prepared by using carrier $A_{23}$, fog occurred from the initial stage similarly to Comparative Example 1 and image density was insufficient. In the running test with a long lapse of time, the developer prepared by using carrier $A_{23}$ caused extremely low charge quantity, considerable fog and toner splash, not withstanding continuous use. The charge quantities in the initial stage and after continuous running are shown in Table 1.

Comparative Example 3

Carrier $A_{23}$ was coated with a methylsilicone resin in the same manner as in Example 1 to prepare carrier $A_{24}$. In the running test, the developer prepared by using carrier $A_{24}$ caused considerable fog from the initial stage, not withstanding continuous use, similarly to Comparative Example 1. The initial charge quantity is shown in Table 1.

TABLE 1

| | | Treatment for Resin Coat Removal | Regenerated Carrier | | | | Charge Quantity (μC/g) | |
|---|---|---|---|---|---|---|---|---|
| | | | C Content (wt %) | Si Content (wt %) | Removal of Resin Coat | Re-coating with resin | Initial | After Running Test |
| Examples | 1 | washing with 10% KOH aq. solution (70° C.) | <0.01 | <0.01 | complete | yes | 11.4 | 15.1 |
| | 2 | washing with 10% NaOH aq. solution (70° C.) | <0.01 | <0.01 | complete | yes | 12.0 | 16.0 |
| | 3 | washing with 10% KOH aq. solution (50° C.) | <0.01 | <0.01 | complete | yes | 11.6 | 15.0 |
| | 4 | washing with 3% KOH aq. solutioh (70° C.) | 0.01 | 0.02 | slightly incomplete | yes | 10.0 | 13.6 |
| | 5 | washing with 10% KOH aq. solution (room temperature) | 0.04 | 0.08 | incomplete | yes | 8.6 | 13.2 |
| | 6 | washing with 10% KOH aq. solution (50° C.) | <0.01 | <0.01 | complete | yes | 9.2 | 17.0 |
| Comparative Examples | 1 | Firing in tunnel kiln (700° C.) | <0.01 | 0.12 | incomplete | yes | 5.9 | — |
| | 2 | washing with toluene | 0.07 | 0.12 | complete | no | 8.0 | 3.0 |
| | 3 | washing with toluene | 0.07 | 0.12 | incomplete | yes | 3.8 | — |

What is claimed is:

1. A method for regenerating a carrier coated with a silicone resin or a resin containing a silane coupling agent in an electrophotographic developer comprising the carrier and a toner, which comprises separating the developer into the carrier and the toner, immersing the separated carrier in an aqueous alkali solution, and stirring the mixture to remove the toner component adhered to the carrier surface and the coating silicone resin or the coating resin containing the silane coupling agent.

2. The method according to claim 1, wherein said aqueous alkali solution has a concentration of 5% or higher.

3. The method according to claim 1, wherein said aqueous alkali solution has a temperature of 50° C. or higher.

4. The method according to claim 1, wherein the carrier from which the toner component and the coating resin has been removed is coated with a resin.

5. The method according to claim 4, wherein said resin for coating the carrier is a silicone resin or a resin containing a silane coupling agent.

6. An electrophotographic developer containing a carrier obtained by the method according to claim 1.

* * * * *